United States Patent [19]

Finger

[11] Patent Number: 4,702,612

[45] Date of Patent: Oct. 27, 1987

[54] COMPASS-WATCH CASE

[75] Inventor: Hansjörg Finger, Lengnau, Switzerland

[73] Assignee: Firma H. Finger, Switzerland

[21] Appl. No.: 880,194

[22] Filed: Jun. 30, 1986

[30] Foreign Application Priority Data

Jul. 10, 1985 [CH] Switzerland ..... 2988/85

[51] Int. Cl.[4] ..... G04B 47/00

[52] U.S. Cl. ..... 368/10; 368/14; 368/278; 33/355 R

[58] Field of Search ..... 368/10, 11, 14–15, 368/20, 228, 232, 278; 33/271, 355

[56] References Cited

U.S. PATENT DOCUMENTS

| | | | |
|---|---|---|---|
| 1,217,937 | 3/1917 | Greene | 33/271 |
| 1,435,633 | 11/1922 | Eisenmann | 33/355 |
| 1,560,482 | 7/1925 | Nolsom | 33/355 |
| 2,108,263 | 2/1938 | L'aubee-Lund | 33/355 |
| 2,541,432 | 2/1951 | Muehlbauer | 33/355 |
| 2,857,734 | 10/1958 | Weigenant | 368/14 |

FOREIGN PATENT DOCUMENTS

| | | | |
|---|---|---|---|
| 1085101 | 7/1960 | Fed. Rep. of Germany | 368/14 |
| 2355276 | 1/1978 | France . | |
| 2381344 | 9/1978 | France . | |
| 46732 | 3/1909 | Switzerland | 368/14 |
| 70460 | 9/1915 | Switzerland | 33/355 |
| 244098 | 2/1947 | Switzerland | 368/14 |
| 346826 | 7/1960 | Switzerland | 368/14 |
| 456363 | 12/1936 | United Kingdom . | |
| 738910 | 10/1955 | United Kingdom . | |

*Primary Examiner*—Vit W. Miska

*Attorney, Agent, or Firm*—Parkhurst & Oliff

[57] ABSTRACT

The compass is composed of a glass plate constituting a transparent outer component and of a thin plate constituting an inner transparent component. Two bearings are fixed in holes in these plates, one bearing being situated near the upper face and covered by a disk. An arbor can thus be machined with a maximum length and can support the compass needle with the greatest possible precision. The compass unit, comprising a setting ring which holds the two plates in place, may be driven with a gasket into the radial wall of the case body in lieu of the usual watch glass.

9 Claims, 5 Drawing Figures

COMPASS-WATCH CASE

This invention relates to instrument housings, and more particularly to a watch case of the type having two parallel partition elements, at least one of which is transparent, a space occupied by a gas between these partition elements, a compass needle movable in the space, and an arbor supporting the compass needle.

Compass-watches are generally heavy, clumsy, and unattractive objects. Moreover, the connection between the enclosure forming the compass and the watch case proper includes additional elements which complicate manufacture of the article as a whole and increase its cost price.

On the other hand, the magnetized needles of compasses are often integral with a pivot part in the form of a cup-bearing fitted on a pivot projecting from the bottom of the compass enclosure. An arrangement of this type is described, for example, in U.K. Pat. No. 456,363. Such pivoting devices have also been proposed for compass-watches (cf. French Patent Application Publication No. 2,355,276), as have arrangements where the compass needle is placed in a liquid (cf. French Patent Application Publication No. 2,381,344).

It is an object of this invention to provide an improved case for a watch combined with a compass wherein the two components are attractively integrated without the need for any cumbersome auxiliary device, and in such a way that nothing interferes with the operation and utilization of the two components.

To this end, in the watch case according to the present invention, of the type initially mentioned, the arbor has pivots at both ends, each including a cylindrical portion, each partition element supports a bearing device, and each bearing device includes a jewel bearing rigidly fixed to the corresponding partition element and having a central opening fitted on the cylindrical portion of one of the pivots.

Figure 1:
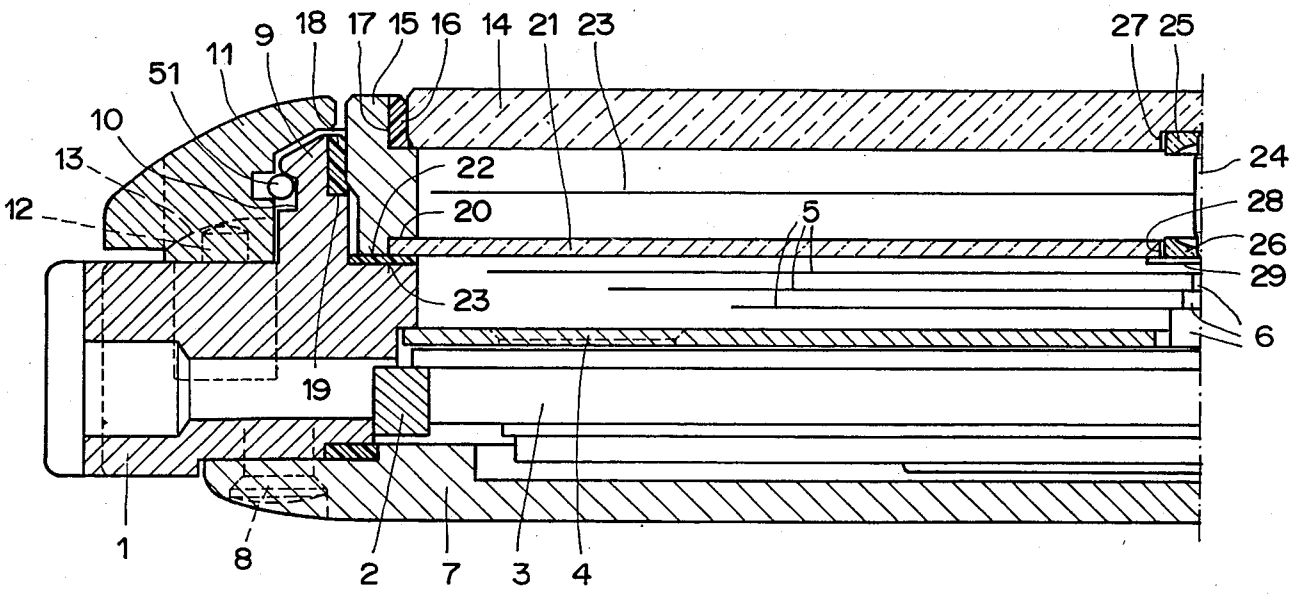
Figure 2:
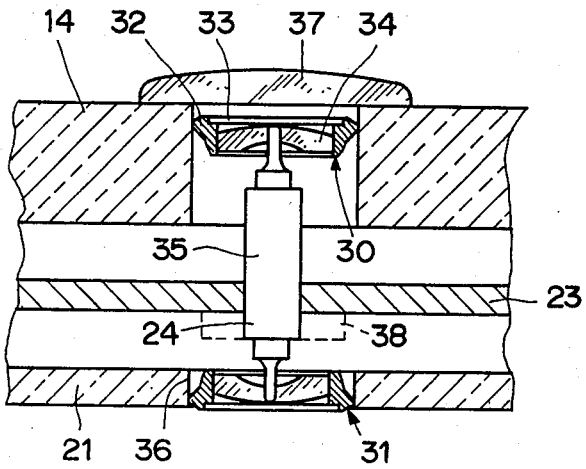
Figure 3:
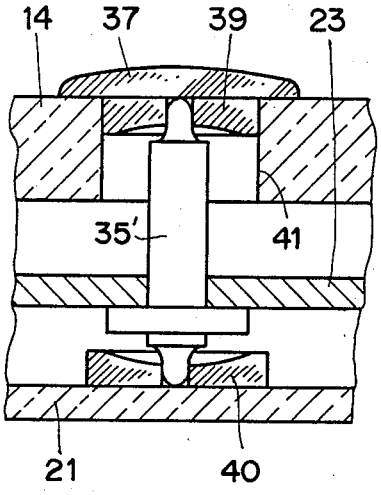
Figure 4:
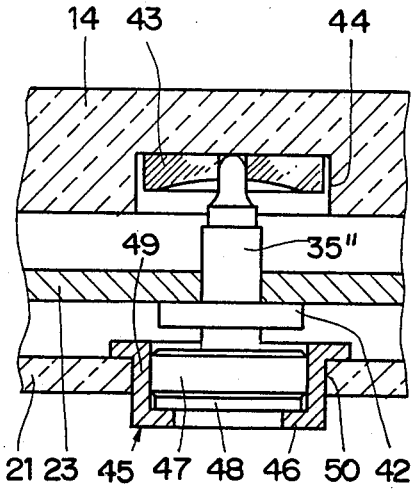
Figure 5:
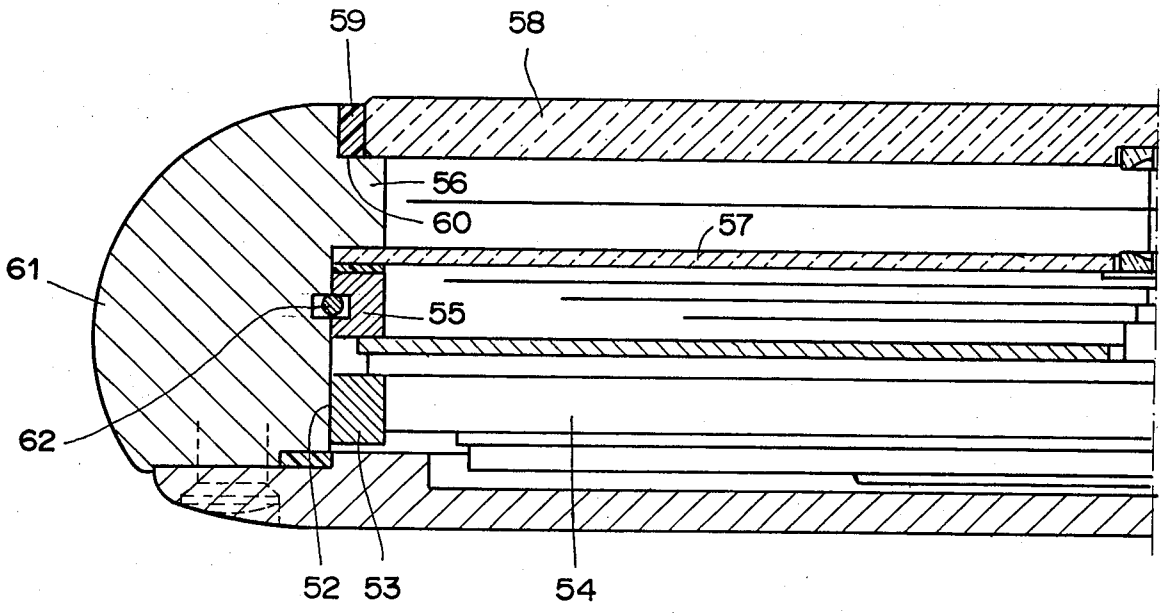

Two preferred embodiments of the invention will now be described in detail with reference to the accompanying drawings, in which:

FIG. 1 is a partial axial section through the case,

FIGS. 2, 3, and 4 are partial axial sections on a larger scale, showing different variations of means for pivoting the compass needle, and FIG. 5 is a view analogous to FIG. 1, showing a second embodiment of the invention.

The compass-watch case illustrated in FIG. 1 comprises an annular case body 1, shown in FIG. 1 in an axial section taken on the 3 o'clock-9 o'clock axis. A casing ring 2 fitted within case body 1 supports a watch movement 3 bearing a dial 4, above which there move hands 5 supported by arbors 6 pivoting at the center of movement 3. The rear or lower part of the case is closed by a bottom 7 held in place by screws 8.

At the top of case body 1 is an annular wall 9, the outside surface of which has a groove 10 accommodating a spring wire 51 for holding a rotating bezel 11 which bears graduations, for example, the significance of which is of no importance here. A spring-mounted pin 12 allows bezel 11 to be locked in one or another of a series of predetermined positions marked by recesses 13 in the underside of bezel 11. Peripheral wall 9 of case body 1 likewise holds in place the elements serving as the watch glass and, in the design being described, forming a completely transparent compass unit, so that hands 5 are visible through this unit. A transparent outer part 14 is formed of a plate of mineral glass or sapphire which may be 1 mm thick, for example, and is fixed in a metal setting ring 15 by means of a sealing ring 16 of a deformable material fitted into a shoulder 17 of setting ring 15. Ring 15 is itself fitted into wall 9 and held in place by radial compression of a gasket 18 which is in turn accommodated in a shoulder 19 of wall 9. Milled into the bottom edge of setting ring 15 is an undercut 20 in which the periphery of a transparent inner part 21 is fitted, consisting of a plate of mineral glass or plastic thinner than glass 14. Inner plate 21 may be cemented to setting ring 15, but it may equally well be gripped by axial compression of a flat gasket 22 of soft material disposed on a shoulder 23 of case body 1.

Parts 14, 21, and 15 thus constitute a fairly flat capsule or container, the surface area of which corresponds to the area of the visible face of the watch and which is completely transparent so that hands 5 are visible through it. This capsule contains a compass needle 23 fixed to an arbor 24 supported in two bearings 25 and 26. Arbor 24 is machined with a pivot at each end, including a cylindrical portion, and with a rounded or flattened tip.

In FIG. 1, bearing 25 is a jewel bearing with a hole in the center. It is cemented in a flat-bottomed recess 27 in transparent outer part 14. The other bearing, 26, is also a pierced jewel. It is fitted in a hole 28 passing completely through plate 21 and is held in place by a small, thin plate 29 cemented to the underside of plate 21 and constituting an endpiece.

FIGS. 2, 3, and 4 show different modifications of the bearings in which arbor 24, carrying needle 23, pivots. In the first modification, arbor 24 is supported by two bearings 30 and 31, each composed of a setting 32, an endpiece 33, and a pierced jewel 34. These elements are known per se from the technology of watch-bearing manufacture and need not be described in detail. For assembling these bearings, each of the transparent parts 14 and 21 is pierced with a hole 35 or 36 fitted to the outside diameter of the setting 32. Each bearing may therefore be fitted as a unit inside the corresponding hole and held either by friction or cementing. It will further be noted that upper bearing 30 is vertically adjustable within cylindrical hole 35. A glass disk 37 is cemented at the top of hole 35 to make the bearing fluid-tight.

Owing to the arrangement described, the pivots of arbor 24 may be precisely adjusted in the bearings, and arbor 24 can furthermore be made as long as possible. Since bearing 30 may be situated immediately next to disk 37, it is evident that the whole thickness of glass plate 14 is available for extending the length of the arbor, thus improving the pivoting of needle 23. This needle may be secured to arbor 24 by means of an added ring 38 or by any other means.

The two modifications of FIGS. 3 and 4 present the same advantage as that of FIG. 2 and the embodiment of FIG. 1 as regards pivoting of needle 23. In the design of FIG. 3, needle 23 is mounted on an arbor 35' having pivots with rounded ends fitted in jewels 39 and 40. Upper jewel 39 is fixed in a hole 41 in glass plate 14, near the top of the hole, with disk 37 serving here as an endstone. As for jewel 40, it is seen to be cemented on the inner face of glass plate 21 which, in this modification, is not drilled. With this solution, the pivot is slightly shortened at the lower level of the compass unit; but at the upper level, the entire thickness of plate 14 may be used for extending the length of arbor 35'.

In the modification of FIG. 4, an arbor 35" bearing needle 23 has a collar 42 instead of the added ring 38. An upper bearing 43 is a jewel analogous to jewel 39 but is cemented here in the bottom of a flat-bottomed recess 44 in glass plate 14. As for the lower bearing, 45, it is seen to be a composite bearing having a setting 46 containing a jewel 47 and an endstone 48, setting 46 including a sidewall 49 fitted in a hole 50 in inner plate 21 and projecting slightly beyond that plate. Hence the pivoting of needle 23 is achieved with the maximum possible precision in this case, too, thus facilitating operation of the compass and enabling the thickness of the unit inserted in peripheral wall 9 of case body 1 to be kept to a minimum.

In an actual reduction to practice, the compass unit had a total thickness of 2.8 mm, using an inner plate 21 of 0.3 mm and an outer plate 14 of 1 mm. The overall thickness of the watch was 7.3 mm, and it had the appearance of an ordinary watch. The compass needle and the hands were all visible at the same time, one upon the other, thus making it possible to read both instruments quickly and easily.

It will be realized that the arrangement described is also very simple from the production standpoint and does not involve any complications in assembly since the compass unit can be put in place like a conventional watch glass.

FIG. 5 shows another embodiment in which the elements making up the compass and the glass are not assembled in an independent unit, as in FIG. 1. The case comprises an annular body 61, an inner annular face 52 of which is machined to receive a casing ring 53 supporting a movement 54. As in the first embodiment, the movement will preferably be a mechanical one; but with appropriate shielding from the magnetic influence of the compass needle, or with weak enough magnetization thereof, the case may also take an electronic movement.

A second inner ring 55 is fixed within body 61 by a rippled spring wire 62 fitted in corresponding grooves in case body 61 and ring 55. Ring 55 presses a thin inner glass plate 57 against the underside of an upper flange 56. The height of ring 55 corresponds to the height of the hand assembly, and this ring functions as the usual bezel flange. The upper flange, on the other hand, is bounded at the top by a shoulder 60 forming the bottom of a glass-snap holding a plate 58 of mineral glass or sapphire fixed by means of a gasket 59. A compass needle is pivoted between the two transparent plates 57 and 58 by the means described with reference to FIGS. 1–4.

The design of FIGS. 1–4 might also be used to produce an independent compass unit, e.g., a very thin article having a mounting of precious metal, suitable for wear as a pendant.

What is claimed is:

1. A compass assembly comprising a first plate of transparent material and a second plate rigidly fixed with respect to said first plate, said first and second plates having parallel planar inner faces facing one another and spaced apart, said first plate having a first passage formed therein with an opening in the inner face of said first plate; a first bearing assembly mounted within said first passage and comprising a first drilled jewel and a first end portion, said first drilled jewel comprising a first drilled portion with a first cylindrical borehole having a first inner edge which lies farther from the inner face of said second plate then does the inner face of said first plate; a second bearing assembly secured to said second plate and being coaxial with said first bearing assembly, said second bearing assembly comprising a second drilled jewel and a second end portion; an arbor having two pivots provided at opposite ends thereof, each of said pivots including a cylindrical portion, said cylindrical portions being received within said first and second drilled jewels; and a compass needle formed integrally with said arbor and extending between the inner faces of said first and second plates.

2. The compass assembly according to claim 1, wherein said second plate is thinner then said first plate.

3. The compass assembly according to claim 2, wherein said second plate has a second passage formed therein with an opening in the inner face of said second plate, said second bearing assembly being mounted within said second passage, said second drilled jewel having a second cylindrical borehole therein with a second inner edge which lies farther from the inner face of the first plate then does the inner face of the second plate.

4. The compass assembly according to claim 2, wherein at least one of said bearing assemblies comprises a ring shaped protruding portion which extends around the corresponding cylindrical portion of said arbor beyond the inner face of the plate upon which said bearing assembly is mounted.

5. The compass assembly according to claim 2, wherein at least one of said bearing assemblies comprises a ring shaped setting having at least one of said jewels and one of said end portions secured thereto, and wherein said setting has a peripheral portion projecting beyond the inner face of the plate upon which said bearing assembly is mounted.

6. The compass assembly according to claim 2, wherein both of said plates are of transparent material.

7. A watch case comprising a case body of annular shape; a bottom removably fixed at a back part of said case body; means for securing a watch movement having a dial at a top portion thereof in said case body; and a compass assembly mounted above said watch movement, said compass assembly comprising a first plate of transparent material and a second plate rigidly fixed with respect to said first plate, said first and second plates having parallel planar inner faces facing one another and spaced apart, said first plate having a first passage formed therein with an opening in the inner face of said first plate, a first bearing assembly mounted within said first passage and comprising a first drilled jewel and a first end portion, said first drilled jewel comprising a first drilled portion with a first cylindrical borehole having a first inner edge which lies farther from the inner face of said second plate then does the inner face of said first plate, a second bearing assembly secured to said second plate and being coaxial with said first bearing assembly, said second bearing assembly comprising a second drilled jewel and a second end portion, an arbor having two pivots provided at opposite ends thereof, each of said pivots including a cylindrical portion, said cylindrical portions being received within said first and second drilled jewels, and a compass needle formed integrally with said arbor and extending between the inner faces of said first and second plates; wherein said second plate is of transparent material thereby enabling said dial of said watch movement to be visible through said compass assembly.

8. The watch case according to claim 7, wherein said compass assembly further comprises a setting ring which holds said first and second plates of transparent material to one another, and said case body comprises a ring shaped projection at the top portion thereof, said setting ring being driven into said ring shape projection into case body.

9. The watch case according to claim 8, further comprising a rotating bezel encircling said ring shaped projection of said case body.

* * * * *